US009636916B2

(12) United States Patent
Akiyama et al.

(10) Patent No.: US 9,636,916 B2
(45) Date of Patent: May 2, 2017

(54) INK TEMPERATURE ADJUSTMENT DEVICE AND INK CIRCULATION TYPE INKJET PRINTER HAVING THE SAME

(71) Applicant: RISO KAGAKU CORPORATION, Tokyo (JP)

(72) Inventors: Tomoyuki Akiyama, Ibaraki (JP); Asayo Shimoda, Ibaraki (JP); Hiroshi Sugitani, Ibaraki (JP); Akira Nishiyama, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/826,460

(22) Filed: Aug. 14, 2015

(65) Prior Publication Data

US 2016/0059565 A1 Mar. 3, 2016

(30) Foreign Application Priority Data

Aug. 28, 2014 (JP) ..... 2014-173886

(51) Int. Cl.
*B41J 2/175* (2006.01)
*B41J 2/195* (2006.01)

(52) U.S. Cl.
CPC ..... *B41J 2/175* (2013.01); *B41J 2/195* (2013.01)

(58) Field of Classification Search
USPC ..... 347/223, 89
See application file for complete search history.

(56) References Cited

U.S. PATENT DOCUMENTS 4,149,390 A * 4/1979 Iijima ..... F25B 39/02 165/176
5,699,675 A * 12/1997 Nagai ..... F25B 9/006 165/150
6,174,055 B1 * 1/2001 Sugikubo ..... B41J 3/4078 347/18
7,427,116 B2 * 9/2008 Nakamura ..... B41J 25/308 347/22

(Continued)

FOREIGN PATENT DOCUMENTS

CN 102036829 4/2011
CN 103223782 7/2013

(Continued)

OTHER PUBLICATIONS

Extended European Search Report for EP 15182523.9 having a mailing date of Feb. 5, 2016.

*Primary Examiner* — Matthew Luu
*Assistant Examiner* — Lily Kemathe
(74) *Attorney, Agent, or Firm* — Greenblum & Bernstein, P.L.C.

(57) ABSTRACT

An ink temperature adjustment device and an inkjet printer include an ink temperature adjustment path connected to a midway point on an ink supply path for supplying ink to an inkjet head configured to form an image by ejecting the ink. The ink temperature adjustment path is for adjusting a temperature of the ink supplied to the inkjet head. The ink temperature adjustment path includes an upflow path for the ink to flow upward and a downflow path for the ink to flow downward. A total cross-sectional area of the upflow path is larger than a total cross-sectional area of the downflow path.

8 Claims, 5 Drawing Sheets

(56) References Cited

U.S. PATENT DOCUMENTS

| | | | | |
|---|---|---|---|---|
| 2007/0183805 | A1* | 8/2007 | Tsukada | G03G 15/2039 399/69 |
| 2007/0188994 | A1* | 8/2007 | Tsai | F28D 15/0266 361/701 |
| 2008/0245099 | A1* | 10/2008 | Inaba | F25B 39/022 62/515 |
| 2010/0066785 | A1 | 3/2010 | Yamada et al. | |
| 2011/0128335 | A1 | 6/2011 | Von Essen et al. | |
| 2011/0242155 | A1 | 10/2011 | Bansyo | |
| 2013/0194324 | A1 | 8/2013 | Snyder et al. | |
| 2013/0194326 | A1 | 8/2013 | Ito | |

FOREIGN PATENT DOCUMENTS

| | | |
|---|---|---|
| EP | 2738006 | 6/2014 |
| JP | 2007-001128 | 1/2007 |
| JP | 2011-207064 | 10/2011 |
| JP | 2012-153004 | 8/2012 |

* cited by examiner

INK TEMPERATURE ADJUSTMENT DEVICE AND INK CIRCULATION TYPE INKJET PRINTER HAVING THE SAME

CROSS REFERENCE TO RELATED APPLICATION

This application is based upon and claims the benefit of priority from the prior Japanese Patent Application No. 2014-173886, filed on Aug. 28, 2014, the entire contents of which are incorporated herein by reference.

BACKGROUND

1. Technical Field

The disclosure relates to an ink temperature adjustment device and an ink circulation type inkjet printer which are configured to adjust the temperature of ink to be supplied to an inkjet head configured to form an image by ejecting the ink.

2. Related Art

An ink circulation type inkjet printer has been known which is configured to perform printing by ejecting ink from an inkjet head while circulating the ink. Japanese Unexamined Patent Application Publication No. 2012-153004 describes an ink circulation type inkjet printer including a positive-pressure tank and a negative-pressure tank arranged below an inkjet head, and an air pump configured to send air from the negative-pressure tank into the positive-pressure tank.

When performing printing, this inkjet printer directs air from the negative-pressure tank into the positive-pressure tank with the air pump to thereby apply negative pressure and positive pressure to the negative-pressure tank and the positive-pressure tank, respectively. As a result, ink flows from the positive-pressure tank to the inkjet head. The ink which is not consumed by the ink head is collected into the negative-pressure tank, from which the ink is sent into the positive-pressure tank by an ink pump. The ink circulation is performed in this manner.

Here, for the ink to be circulated, the viscosity of the ink needs to be maintained at certain degrees. For this reason, a temperature adjustment mechanism configured to adjust the temperature of the ink is provided on the ink circulation path. This temperature adjustment mechanism, for example, includes a heat sink and a heater provided on the ink path, and heats or cools the circulated ink passing through the heat sink and heater to maintain the ink at proper temperatures.

SUMMARY

Meanwhile, in order to efficiently heat and cool the ink in the above temperature adjustment mechanism, it is effective to lengthen the path inside the temperature adjustment mechanism to thereby increase the time of passage. As a method for this lengthening, the path inside the temperature adjustment mechanism may be formed to meander. However, with a meandering ink path, there is a possibility that air bubbles remain at the bent portions when the ink is initially filled and that these air bubbles flow into the head and cause abnormal ink ejection.

It is an object of the present invention to provide an ink temperature adjustment device and an ink circulation type inkjet printer which are capable of efficiently adjusting the temperature of ink by increasing the length of an ink path in the ink circulation type inkjet printer and, at the same time, reducing air bubbles remaining in the path to prevent the occurrence of abnormal ink ejection at an ink head.

An ink temperature adjustment device in accordance with some embodiments includes an ink temperature adjustment path connected to a midway point on an ink supply path for supplying ink to an inkjet head configured to form an image by ejecting the ink. The ink temperature adjustment path is for adjusting a temperature of the ink supplied to the inkjet head. The ink temperature adjustment path includes an upflow path for the ink to flow upward and a downflow path for the ink to flow downward. A total cross-sectional area of the upflow path is larger than a total cross-sectional area of the downflow path.

Here, as a way to make the "total cross-sectional area" of the upflow path larger, the upflow path may be branched or the diameter of the flow path may be increased, for example, so that the cross-sectional area can be made larger than that of the downflow path. As a way to make the "total cross-sectional area" of the downflow path smaller, a plurality of flow paths may be merged, or the diameter of the flow path may be reduced.

According to the above configuration, the total cross-sectional area of the downflow path is made smaller than that of the upflow path. In this way, the speed of the ink flow can be increased, thereby making it possible to reduce air bubbles generated and remaining in the ink at bent portions and branching points on the flow path and to supply the ink smoothly. On the other hand, as for the upflow path, the flow path may be branched or the diameter thereof may be increased, for example, so that the cross-sectional area of the flow path can be increased. In this way, the heat exchange ratio along the path surface can be increased and effective temperature adjustment can therefore be achieved.

Specifically, in an upflow path, air bubbles are also directed upward by their buoyancy. Then, with the presence of the ink flow, the air bubbles are less likely to remain in the flow path. In the above configuration, by taking advantage of this condition, the upflow path is, for example, branched or bent so that the surface area thereof can be increased. In this way, the heat exchange ratio is increased and, even if air bubbles are generated, the air bubbles will flow naturally upward through the upflow path and will therefore not remain therein. On the other hand, in a downflow path, air bubbles are directed upward by their buoyancy whereas the ink flow is directed downward, so that the air bubbles move against the ink flow. Thus, the air bubbles are more likely to remain at bent portions and branching points on the flow path. In view of this, in the above configuration, the total cross-sectional area of the downflow path is made smaller, for example. In this way, the speed of the ink flow increases, thereby making it possible to push out accumulated air bubbles and smoothly supply the ink without allowing the air bubbles to remain. Hence, it is possible to make the temperature adjustment more efficient and to reduce residual air bubbles at the same time.

The upflow path may include: a first upflow path connected to an inlet path through which the ink is introduced to an inside of the ink temperature adjustment device from an outside of the ink temperature adjustment device; and a second upflow path connected to the first upflow path via the downflow path and connected to an outlet path through which the ink is discharged to the outside of the ink temperature adjustment device from the inside of the ink temperature adjustment device.

According to the above configuration, the upflow path is divided into the first upflow path on the inlet path side and the second upflow path on the outlet path side, and they are connected by the downflow path therebetween. In this way, for example, the first upflow path can be arranged for cooling and the second upflow path can be arranged for heating, and the ink temperature adjustment path can be made compact as well. This makes it possible to achieve size reduction of the device as a whole and space saving.

The first upflow path may be branched into a plurality of first flow paths. The second upflow path may be branched into a plurality of second flow paths. The downflow path may be a single flow path to which the plurality of first flow paths and the plurality of second flow paths are merged. A total number of the plurality of second flow paths and the downflow path may be equal to a number of the plurality of first flow paths.

According to the above configuration, the total the number of the second flow paths branched in the second upflow path and the downflow path is equal to the number of the first flow paths branched in the first upflow path. In this way, the symmetry of the ink temperature adjustment path can be maintained, and the ink temperature adjustment path can therefore be designed symmetrically between the heating side and the cooling side, for example. This makes it possible to simplify the temperature control and also avoid complication of the device.

The ink temperature adjustment device may further include: a heater configured to heat the ink inside the ink temperature adjustment path; and a heat sink configured to cool the ink inside the ink temperature adjustment path.

An inkjet printer in accordance with some embodiments includes: an inkjet head configured to form an image on a recording medium by ejecting ink on the recording medium based on a drive signal; an ink supply path for supplying the ink to the inkjet head; a recording medium transfer unit configured to transfer the recording medium relative to the inkjet head; and the ink temperature adjustment device arranged at a midway point on the ink supply path.

According to the above configuration, by increasing the total surface area of the upflow path, the heat exchange ratio along the path surface is increased and effective temperature adjustment is therefore achieved; on the other hand, by making the surface area of the downflow path smaller than that of the upflow path, the speed of the ink flow is increased, thereby making it possible to reduce air bubbles remaining in the ink and to supply the ink smoothly to the inkjet head. In this way, images can be formed on a recording medium with high accuracy. Hence, the image quality and the print rate can be improved.

DETAILED DESCRIPTION

Figure 1:
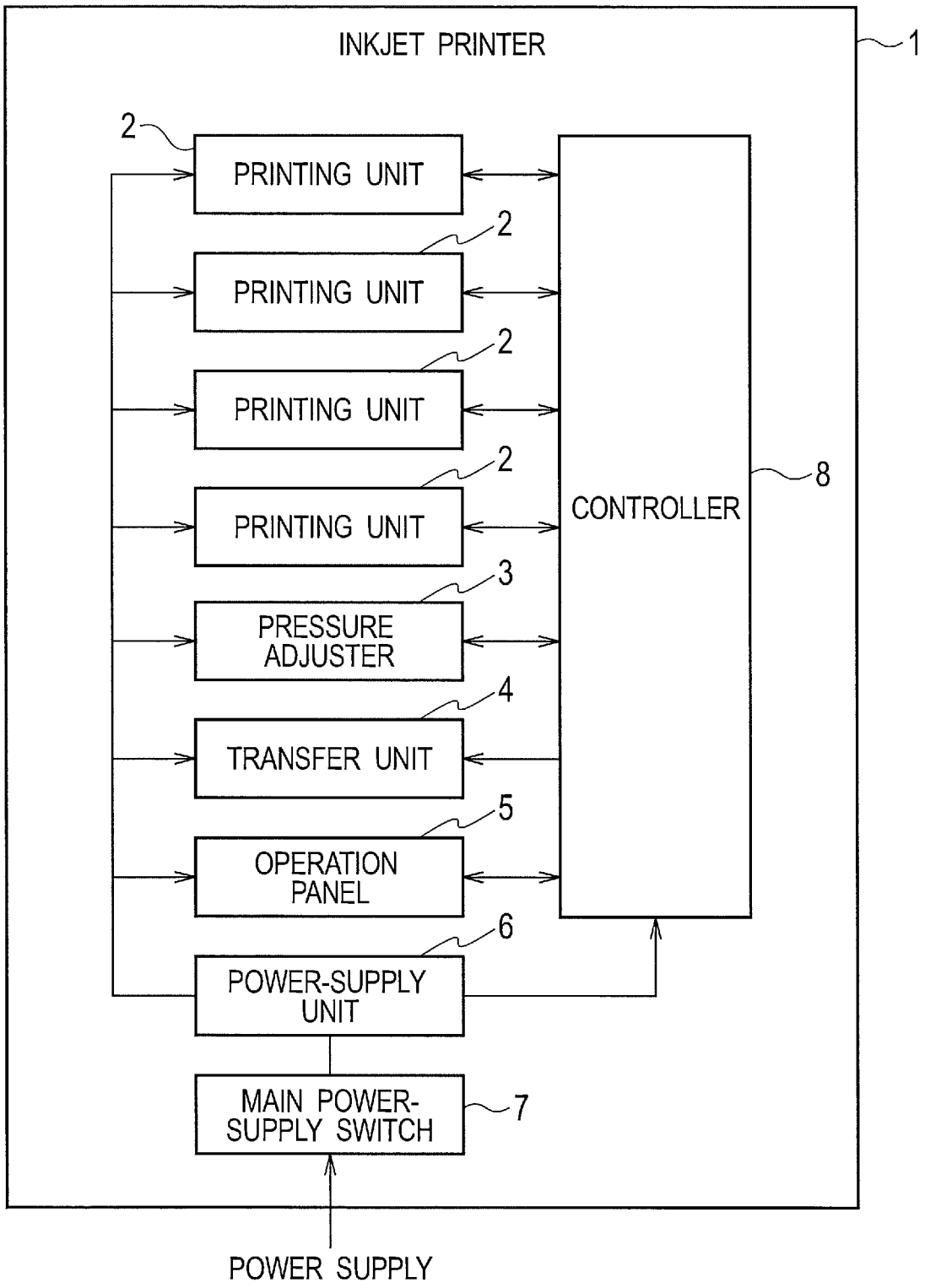
FIG. 1 is a block diagram showing the configuration of an inkjet printer according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
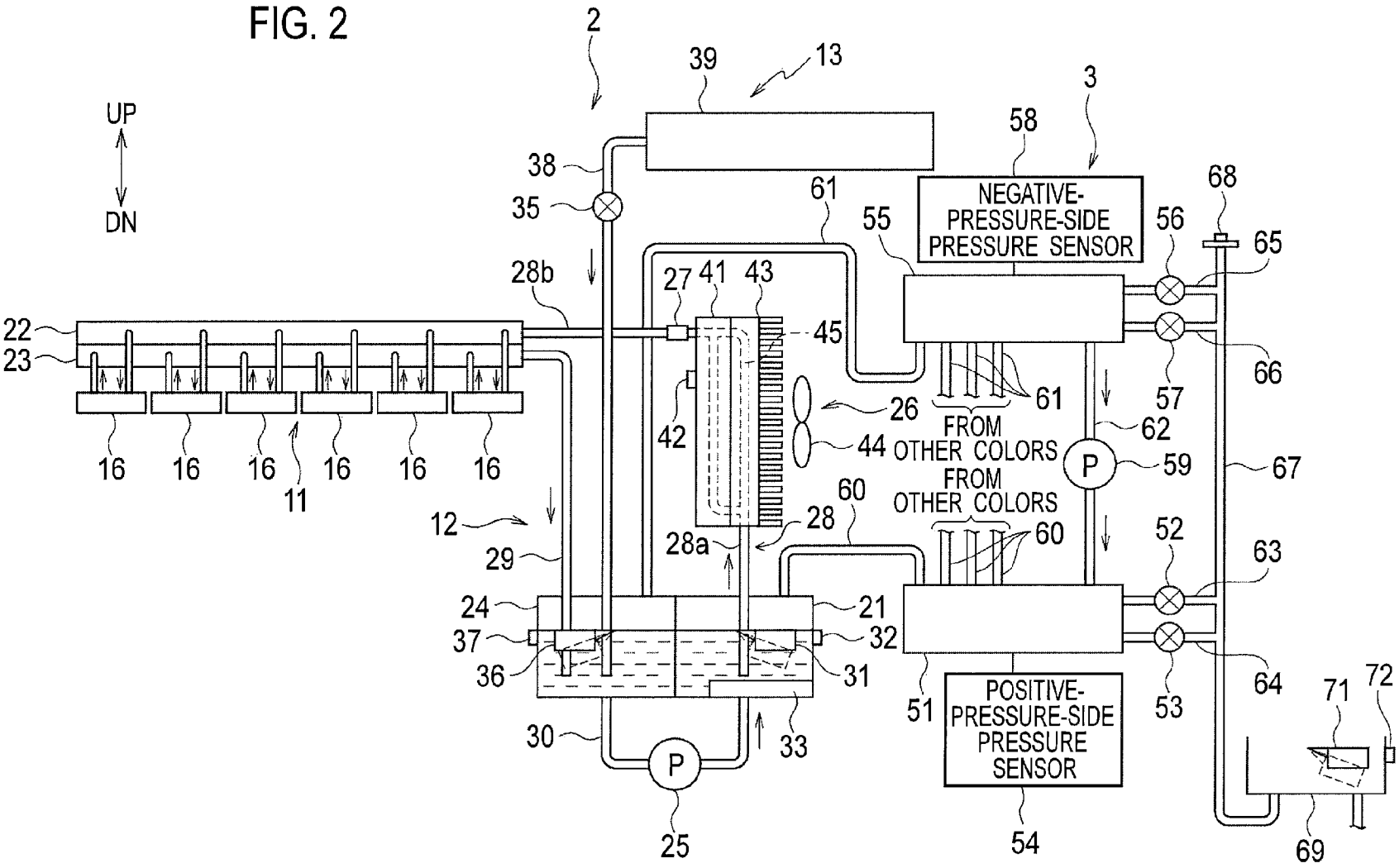
FIG. 2 is a schematic configuration diagram of a printing unit and a pressure adjuster of the inkjet printer shown in FIG. 1.
Figure 3A:
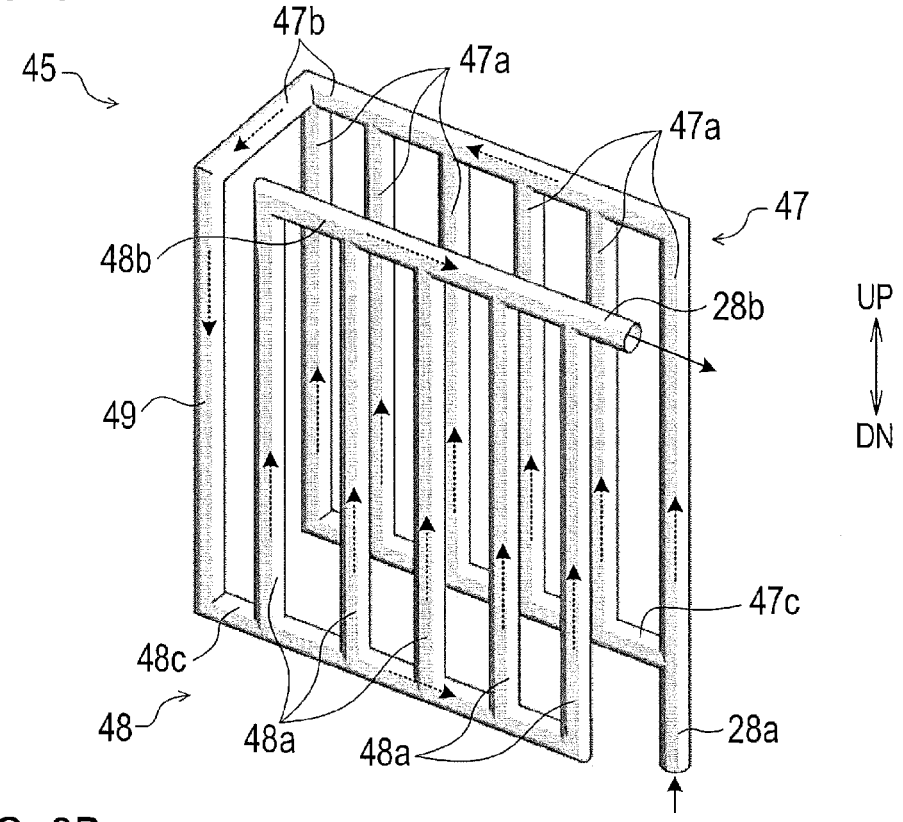
FIG. 3A is a perspective view showing a temperature adjustment path of the inkjet printer shown in FIG. 1.
Figure 3B:
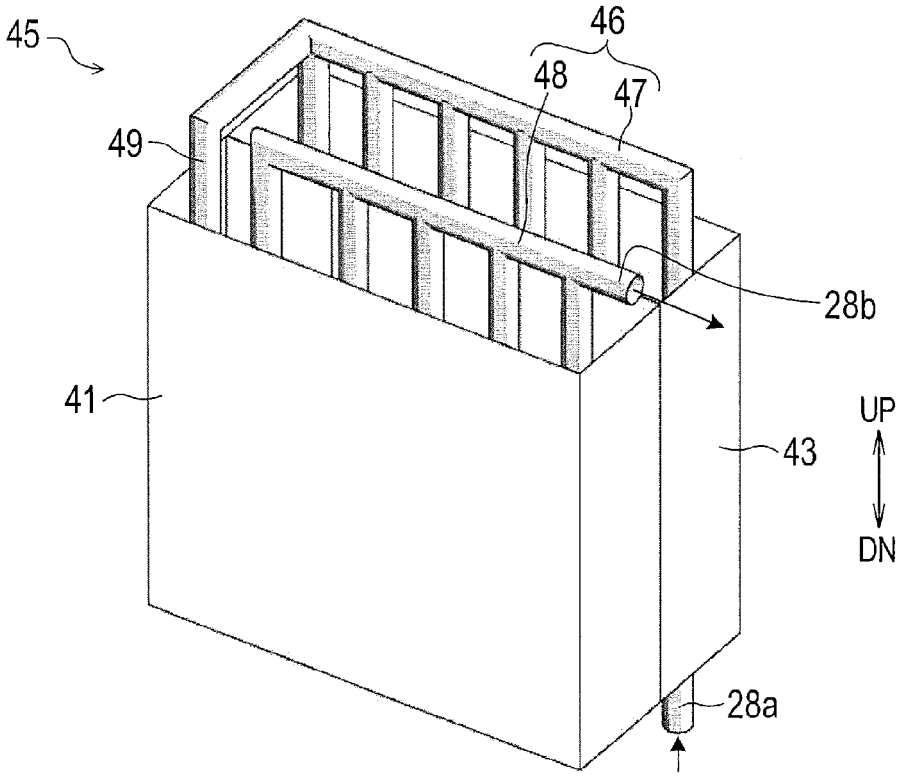
FIG. 3B is a perspective view showing the configuration of an entire ink temperature adjustment device.

FIG. 1 is a block diagram showing the configuration of an inkjet printer according to an embodiment of the present invention. FIG. 2 is a schematic configuration diagram of a printing unit and a pressure adjuster of the inkjet printer shown in FIG. 1. FIG. 3A is a perspective view showing a temperature adjustment path (ink temperature adjustment path) 45 of the inkjet printer shown in FIG. 1. FIG. 3B is a perspective view showing the configuration of an ink temperature adjuster 26. Note that the upward/downward direction in the following description is the vertical direction. In FIGS. 2, 3A, 3B, 5A, 5B, 6A, and 6B, the upward direction is shown as UP and the downward direction is shown as DN.

As shown in FIG. 1, an inkjet printer 1 according to this embodiment includes four printing units 2, a pressure adjuster 3, a transfer unit 4, an operation panel 5, a power-supply unit 6, a main power-supply switch 7, and a controller 8.

Each printing unit 2 is configured to print images by ejecting ink onto a paper sheet, which is transferred by the transfer unit 4, while circulating the ink. The four printing unit 2 are configured to eject inks of respectively different colors (e.g. black (K), cyan (C), magenta (M), and yellow (Y)). The four printing units 2 have similar configurations except that the colors of the inks they eject differ.

The pressure adjuster 3 is configured to adjust pressures be applied to tanks storing therein the inks to be supplied to the printing units 2. The transfer unit 4 is configured to take out a paper sheet from a paper feed tray (not shown) and transfer the paper sheet relative to an inkjet head 11 along a transfer path. The transfer unit 4 include-s rollers configured to transfer the paper sheet, motors configured to drive the rollers (both not shown), and the like.

The operation panel 5 is configured to display various kinds of input screens and the like and also to receive input operations from the user. The operation panel 5 includes an input unit having various operation keys, a touchscreen, or the like, and a display unit having a liquid crystal display panel or the like (both not shown). The input unit is provided with a sub power-supply key (not shown) configured to switch on and off a power supply (sub-power supply).

The power-supply unit 6 is configured to supply power which is supplied through the main power-supply switch 7 to given sections of the inkjet printer 1. The main power-supply switch 7 is a switch configured to switch on and off the main power-supply of the inkjet printer 1. A commercially-available power supply is connected to the main power-supply switch 7. The controller 8 is configured to control the entire operation of the inkjet printer 1.

Configuration of Printing Unit 2

Next, the configuration of each printing unit 2 will be described. As shown in FIG. 2, the printing unit 2 includes the inkjet head 11, an ink circulation unit 12, and an ink supply unit 13.

The inkjet head 11 is configured to form images on a paper sheet by ejecting ink supplied by the ink circulation unit 12. The inkjet head 11 is formed by a plurality of head modules 16.

Each head module 16 is of a piezoelectric type. The head module 16 has an ink chamber configured to store ink and a plurality of nozzles configured to eject the ink (both not shown). Piezoelectric elements (not shown) are arranged in the ink chambers. The ink is ejected from the nozzles by driving the piezoelectric elements.

The ink circulation unit 12 is configured to supply ink to the inkjet head 11 while circulating the ink. The ink circulation unit 12 includes a positive-pressure tank 21, an ink distributor 22, an ink collector 23, a negative-pressure tank 24, an ink pump 25, an ink temperature adjuster 26 (ink temperature adjustment device), an ink temperature sensor 27, and pipes (ink supply path) 28 to 30.

The positive-pressure tank 21 is configured to store ink to be supplied to the inkjet head 11. The ink in the positive-pressure tank 21 is supplied to the inkjet head 11 through the pipe 28 and the ink distributor 22. Inside the positive-pressure tank 21, an air layer is formed on the surface of the ink. The positive-pressure tank 21 is in communication with a later-described positive-pressure common air chamber 51 through a later-described pipe 60. The positive-pressure tank 21 is arranged at a position lower than (below) the inkjet head 11.

The positive-pressure tank 21 has such a volume as to be able of also contain ink dropped thereinto from inside the ink distributor 22 and the pipe 28 when the menisci at the nozzles of the inkjet head 11 break due to vibrations. Note that an excessively large positive-pressure tank 21 increases the size of the device. Thus, the positive-pressure tank 21 has such a volume as to be full when all the ink inside the ink distributor 22 and the pipe 28 is dropped into the positive-pressure tank 21.

The positive-pressure tank 21 is provided with a float member 31, a positive-pressure-tank liquid level sensor 32, and an ink filter 33.

One end side of the float member 31 is pivotally supported on a support shaft (not shown) inside the positive-pressure tank 21 so that the float member 31 can swing in accordance with the liquid level of the ink inside the positive-pressure tank 21 until the liquid level reaches a reference level. A magnet (not shown) is provided at the other end of the float member 31.

The positive-pressure-tank liquid level sensor 32 is configured to detect whether or not the liquid level of the ink inside the positive-pressure tank 21 has reached the reference level. The reference level is located below and away from the upper end of the positive-pressure tank 21 by a predetermined distance. The positive-pressure-tank liquid level sensor 32 is formed of a magnetic sensor and configured to detect the magnet of the float member 31 when the liquid level is or above the reference level. The positive-pressure-tank liquid level sensor 32 outputs a signal indicating "ON" when detecting the magnet of the float member 31, that is, when the liquid level inside the positive-pressure tank 21 is or above the reference level. The positive-pressure-tank liquid level sensor 32 outputs a signal indicating "OFF" when not detecting the magnet of the float member 31, that is, when the liquid level inside the positive-pressure tank 21 is below the reference level.

The ink filter 33 is configured to remove foreign particles and the like in the ink.

The ink distributor 22 is configured to distribute the ink, which is supplied from the positive-pressure tank 21 through the pipe 28, to the head modules 16 of the inkjet head 11.

The ink collector 23 is configured to collect the ink which is not consumed in the inkjet head 11 from the head modules 16. The ink collected by the ink collector 23 flows into the negative-pressure tank 24 through the pipe 29.

The negative-pressure tank 24 is configured to receive and store the ink which is not consumed in the inkjet head 11 from the ink collector 23. Moreover, the negative-pressure tank 24 is configured to store ink supplied from an ink cartridge 39 of the later-described ink supply unit 13. Inside the negative-pressure tank 24, an air layer is formed on the surface of the ink. The negative-pressure tank 24 is in communication with a later-described negative-pressure common air chamber 55 through a later-described pipe 61. The negative-pressure tank 24 is arranged at the same level as the positive-pressure tank 21.

The negative-pressure tank 24 has such a volume as to be able to also contain ink dropped thereinto form inside the inkjet head 11, the ink collector 23, and the pipe 29 when the menisci at the nozzles of the inkjet head 11 break due to vibrations. Note that an excessively large negative-pressure tank 24 increases the size of the device. Thus, the negative-pressure tank 24 has such a volume as to be full when all the ink inside the inkjet head 11, the ink collector 23, and the pipe 29 is dropped into the negative-pressure tank 24.

The negative-pressure tank 24 is provided with a float member 36 and a negative-pressure-tank liquid level sensor 37.

The float member 36 and the negative-pressure-tank liquid level sensor 37 are similar to the float member 31 and the positive-pressure-tank liquid level sensor 32 of the positive-pressure tank 21, respectively. The negative-pressure-tank liquid level sensor 37 outputs a signal indicating "ON" when detecting the magnet of the float member 36, that is, when the liquid level inside the negative-pressure tank 24 is or above a reference level. The negative-pressure-tank liquid level sensor 37 outputs a signal indicating "OFF" when not detecting the magnet of the float member 36, that is, when the liquid level inside the negative-pressure tank 24 is below the reference level. The reference level is located below and away from the upper end of the negative-pressure tank 24 by a predetermined distance.

The ink pump 25 is configured to send ink from the negative-pressure tank 24 into the positive-pressure tank 21. The ink pump 25 is provided at a midway point on the pipe 30.

The pipe 28 is an ink supply path which is connected to the positive-pressure tank 21 and the ink distributor 22 and through which the ink is supplied to the inkjet head 11. Through this pipe 28, the ink flows from the positive-pressure tank 21 toward the ink distributor 22.

The ink temperature adjuster 26 is configured to adjust the temperature of the ink to be supplied to the inkjet head 11. The ink temperature adjuster 26 is arranged at a midway point on the pipe 28. The ink temperature adjuster 26 includes a heater 41, a heater temperature sensor 42, a heat sink 43, a cooling fan 44, and the temperature adjustment path 45 arranged inside the heater 41 and the heat sink 43.

The heater 41 is configured to heat ink inside the temperature adjustment path 45. The heater temperature sensor 42 is configured to detect the temperature of the heater 41. The heat sink 43 is configured to cool the ink inside the temperature adjustment path 45. The cooling fan 44 is configured to direct cooling air onto the heat sink 43.

The temperature adjustment path 45 is connected at both ends to the pipe 28. Specifically, one end of the temperature adjustment path 45 is connected a pipe 28*a* serving as an inlet path through which the ink is introduced to the inside of the ink temperature adjuster 26 from the outside, while the other end of the temperature adjustment path 45 is connected to a pipe 28*b* serving as an outlet path through which the ink is discharged to the outside of the ink temperature adjuster 26 from the inside.

As shown in FIG. 3A, the temperature adjustment path 45 includes an upflow path 46 through which the ink is caused to flow upward and a downflow path 49 through which the ink is caused to flow downward. The upflow path 46 is formed by a first upflow path 47 connected at a lower position to the pipe 28*a* and a second upflow path 48 connected at an upper position to the pipe 28*b*. The first upflow path 47 and the second upflow path 48 are connected by the downflow path 49.

The first upflow path 47 is formed by a plurality of upflow paths 47*a* extending vertically in relation to the installation surface, a lower branching path 47*c* extending horizontally in relation to the installation surface, and an upper merging path 47*b* extending horizontally in relation to the installation surface. The lower branching path 47*c* is formed by a branching pipe which is connected at one end to the pipe 28*a* and through which the ink flowing in from the pipe 28*a* is branched into the upflow paths 47*a*. The upper merging path 47*b* is formed by a collecting pipe which is connected at one end to the downflow path 49 and through which the inks flowing in from the upflow paths 47*a* are merged and caused to flow out into the downflow path 49. The plurality of upflow paths 47*a* are formed by a plurality of straight pipes which are connected at the lower ends to the lower branching path 47*c* and connected at the upper ends to the upper merging path 47*b* and through which the inks are caused to flow upward. The total cross-sectional area of the plurality of upflow paths 47*a* is larger than the total cross-sectional area of the downflow path 49.

The second upflow path 48 is formed by a plurality of upflow paths 48*a* extending vertically in relation to the installation surface, a lower branching path 48*c* extending horizontally in relation to the installation surface, and an upper merging path 48*b* extending horizontally in relation to the installation surface. The lower branching path 48*c* is formed by a branching pipe which is connected at one end to the downflow path 49 and through which the ink flowing in from the downflow path 49 is branched into the upflow paths 48*a*. Note that the total cross-sectional area of the plurality of upflow paths 48*a* is larger than the total cross-sectional area of the downflow path 49. The upper merging path 48*b* is formed by a collecting pipe which is connected at one end to the pipe 28*b* and through which the inks flowing through the upflow paths 48*a* are merged and caused to flow out into the pipe 28*b*. The plurality of upflow paths 48*a* are formed by a plurality of straight pipes which are connected at the lower ends to the lower branching path 48*c* and connected at the upper ends to the pipe 28*b* through the upper merging path 48*b* and through which the inks are caused to flow upward.

The downflow path 49 is formed by straight pipe which is connected at the upper end to the upper merging path 47*b* and connected at the lower end to the lower branching path 48*c* and through which the ink is caused to flow downward. The downflow path 49 extends vertically in relation to the installation surface, and the cross-sectional area of this downflow path 49 is smaller than the total cross-sectional area of the upflow path 47.

Note that the first upflow path 47 and the second upflow path 48 are each branched into a plurality of flow paths, while the downflow path 49 is a single flow path to which these plurality of flow paths are merged, and also the height is the same between the upflow path 46 and the downflow path 49; thus, the total surface area of the upflow path 46 is larger than the total surface area of the downflow path 49.

Moreover, as shown in FIG. 3B, the temperature adjustment path 45 is branched into a section which passes the heater 41 and a section which passes the heat sink 43. Specifically, the first upflow path 47 is arranged inside the heat sink 43 while the second upflow path 48 and the downflow path 49 are arranged inside the heater 41. Note that the total number of the upflow paths 48*a* branched in the second upflow path 48 and the downflow path 49 is equal to the number of the upflow paths 47*a* branched in the first upflow path 47.

As described above, in this embodiment, the first upflow path 47 and the second upflow path 48 are each branched to increase the total path length and therefore increase the total surface area, so that the heat exchange ratio along the path surface is increased. On the other hand, the downflow path 49 is such that the flow paths are merged thereto as a single flow path, and the total cross-sectional area thereof is made smaller than the total cross-sectional area of the upflow paths 47*a*. In this way, the speed of the ink flow in the flow path 49 increases, which reduces air bubbles generated and remaining in the ink at bent portions and branching points on the flow path.

The ink temperature sensor 27 is configured to detect the temperature of the ink in the ink circulation unit 12. The ink temperature sensor 27 is provided at a midway point on the pipe 28*b*.

The pipe 29 connects the ink collector 23 and the negative-pressure tank 24. Through the pipe 29, ink flows from the ink collector 23 toward the negative-pressure tank 24. The pipe 30 connects the negative-pressure tank 24 and the positive-pressure tank 21. Through the pipe 30, the ink flows from the negative-pressure tank 24 to the positive-pressure tank 21. The pipes 28 to 30, the ink distributor 22, and the ink collector 23 form a circulation path through which the ink is circulated among the positive-pressure tank 21, the inkjet head 11, and the negative-pressure tank 24.

The ink supply unit 13 is configured to supply ink to the ink circulation unit 12. The ink supply unit 13 includes the ink cartridge 39, a pipe 38, and an ink supply valve 35.

The ink cartridge 39 houses ink to be used by the printing unit 2 for printing. The ink inside the ink cartridge 39 is supplied into the negative-pressure tank 24 through the pipe 38.

The pipe 38 connects the ink cartridge 39 and the negative-pressure tank 24. Through the pipe 38, the ink flows from the ink cartridge 39 toward the negative-pressure tank 24.

The ink supply valve 35 is configured to open and close the flow path of the ink inside the pipe 38. The ink supply valve 35 is opened at the time of supplying the ink from the ink cartridge 39 into the negative-pressure tank 24.

The pressure adjuster 3 is configured to adjust the pressures in the positive-pressure tank 21 and negative-pressure tank 24 of each printing unit 2. The pressure adjuster 3 includes the positive-pressure common air chamber 51, a positive-pressure-side pressure adjustment valve 52, a positive-pressure-side atmosphere release valve 53, a positive-pressure-side pressure sensor 54, the negative-pressure common air chamber 55, a negative-pressure-side pressure adjustment valve 56, a negative-pressure-side atmosphere release valve 57, a negative-pressure-side pressure sensor 58, an air pump 59, four pipes 60, four pipes 61, pipes 62 to 67, an air filter 68, and an overflow pan 69.

The positive-pressure common air chamber 51 is an air chamber configured to make the pressures in the positive-pressure tanks 21 of the printing units 2 equal to each other. The positive-pressure common air chamber 51 is in communication with the air layers in the positive-pressure tanks 21 of the four printing units 2 through the four pipes 60. Thus, the positive-pressure tanks 21 of the printing units 2 are in communication with each other through the positive-pressure common air chamber 51 and the pipes 60.

The positive-pressure-side pressure adjustment valve 52 is configured to open and close the flow path of air in the pipe 63 to adjust the pressure in the positive-pressure tank 21 of each printing unit 2 through the positive-pressure common air chamber 51. The positive-pressure-side pressure adjustment valve 52 is provided at a midway point on the pipe 63.

The positive-pressure-side atmosphere release valve 53 is configured to open and close the flow path of air in the pipe 64 to switch the state of the positive-pressure tank 21 of each printing unit 2 between a tightly closed state (a state of being shut off from the atmosphere) and an atmospherically open state (a state of being communicating with the atmosphere) through the positive-pressure common air chamber 51. The positive-pressure-side atmosphere release valve 53 is provided at a midway point on the pipe 64.

The positive-pressure-side pressure sensor 54 is configured to detect the pressure in the positive-pressure common air chamber 51 (pressure on the positive pressure side). Here, the pressure in the positive-pressure common air chamber 51 is equal to the pressure in the positive-pressure tank 21 of each printing unit 2 because the positive-pressure common air chamber 51 and the air layer in the positive-pressure tank 21 of each printing unit 2 are in communication with each other.

The negative-pressure common air chamber 55 is an air chamber configured to make the pressures in the negative-pressure tanks 24 of the printing units 2 equal to each other. The negative-pressure common air chamber 55 is in communication with the air layers in the negative-pressure tanks 24 of the four printing units 2 through the four pipes 61. Thus, the negative-pressure tanks 24 of the printing units 2 are in communication with each other through the negative-pressure common air chamber 55 and the pipes 61.

The negative-pressure-side pressure adjustment valve 56 is configured to open and close the flow path of air in the pipe 65 to adjust the pressure in the negative-pressure tank 24 of each printing unit 2 through the negative-pressure common air chamber 55. The negative-pressure-side pressure adjustment valve 56 is provided at a midway point on the pipe 65.

The negative-pressure-side atmosphere release valve 57 is configured to open and close the flow path of air in the pipe 66 to switch the state of the negative-pressure tank 24 of each printing unit 2 between a tightly closed state and an atmospherically open state through the negative-pressure common air chamber 55. The negative-pressure-side atmosphere release valve 57 is provided at a midway point on the pipe 66.

The negative-pressure-side pressure sensor 58 is configured to detect the pressure in the negative-pressure common air chamber 55 (pressure on the negative pressure side). Here, the pressure in the negative-pressure common air chamber 55 is equal to the pressure in the negative-pressure tank 24 of each printing unit 2 because the negative-pressure common air chamber 55 and the air layer in the negative-pressure tank 24 of each printing unit 2 are in communication with each other.

The air pump 59 is configured to send air from the negative-pressure tank 24 of each printing unit 2 into the positive-pressure tank 21 thereof through the positive-pressure common air chamber 51 and the negative-pressure common air chamber 55. The air pump 59 is provided at a midway point on the pipe 62.

The four pipes 60 connect the positive-pressure common air chamber 51 and the positive-pressure tanks 21 of the four printing units 2. Each pipe 60 is connected at one end to the positive-pressure common air chamber 51 and connected at the other end to the air layer of the corresponding positive-pressure tank 21.

The four pipes 61 connect the negative-pressure common air chamber 55 and the negative-pressure tanks 24 of the four printing units 2. Each pipe 61 is connected at one end to the negative-pressure common air chamber 55 and connected at the other end to the air layer in the corresponding negative-pressure tank 24.

The pipe 62 forms a flow path for air to be sent from the negative-pressure common air chamber 55 into the positive-pressure common air chamber 51 by the air pump 59. The pipe 62 is connected at one end to the negative-pressure common air chamber 55 and connected at the other end to the positive-pressure common air chamber 51.

The pipes 63 and 64 are each connected at one end to the positive-pressure common air chamber 51 and connected at the other end to the pipe 67. The pipes 65 and 66 are each connected at one end to the negative-pressure common air chamber 55 and connected at the other end to the pipe 67. The pipe 67 is in communication at one end (upper end) with the atmosphere through the air filter 68 and connected at the other end to the overflow pan 69.

The air filter 68 is provided at the upper end of the pipe 67 and configured to prevent entry of foreign particles and the like in the ambient air.

The overflow pan 69 is configured such that in the case, for example, of malfunction of the ink supply valve 35, which causes the ink to overflow from the positive-pressure tank 21 and the negative-pressure tank and further from the positive-pressure common air chamber 51 and the negative-pressure common air chamber 55, the overflow pan 69 receives that ink.

The overflow pan 69 is provided with a float member 71 and an overflow liquid level sensor 72. The float member 71 and the overflow liquid level sensor 72 are similar to the float member 31 and the positive-pressure-tank liquid level sensor 32 of the positive-pressure tank 21, respectively.

The overflow pan 69 is connected to an effluent tank (not shown) and is configured to discharge the ink into the effluent tank when the overflow liquid level sensor 72 is turned on.

Configuration of Controller 8

Figure 4:
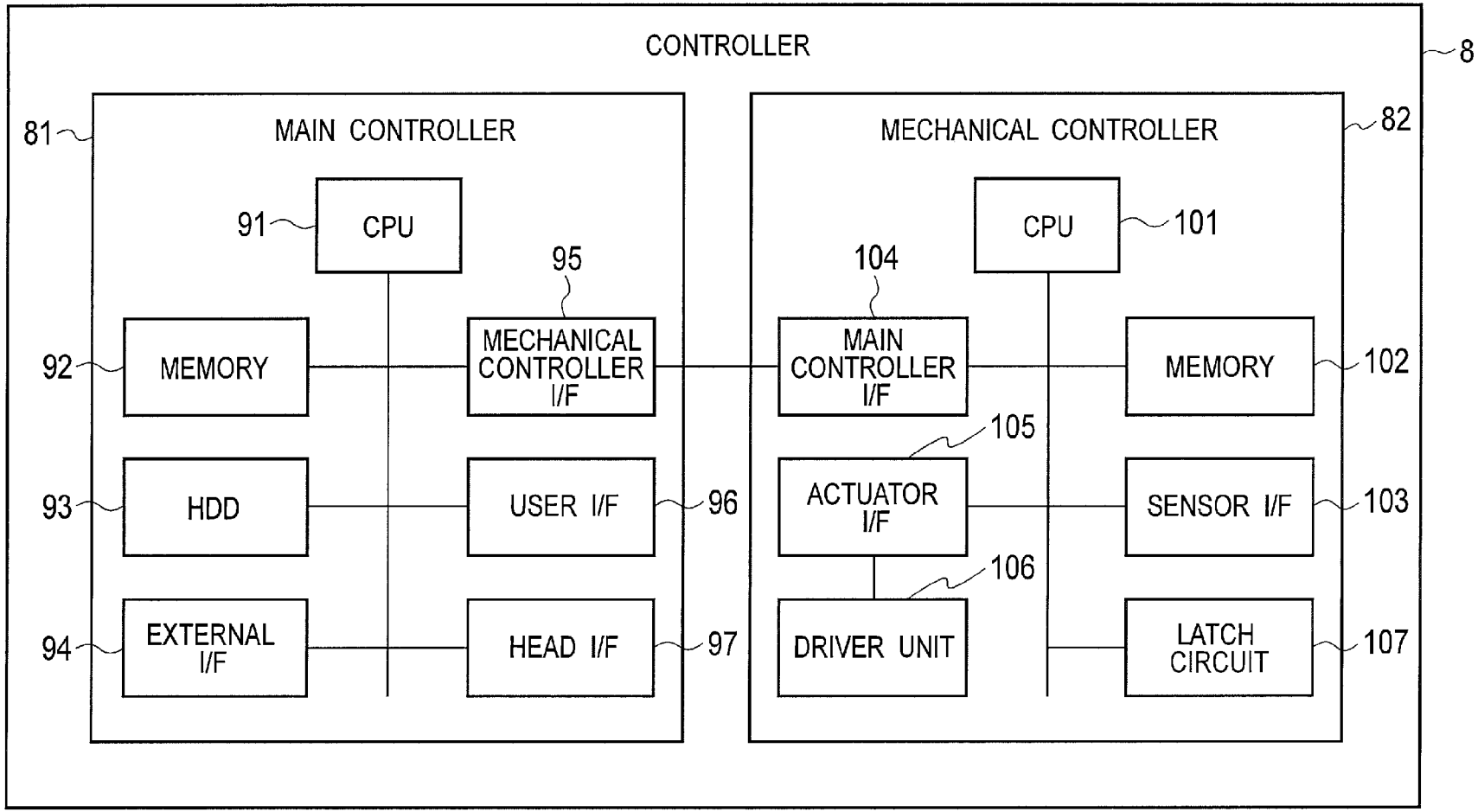
FIG. 4 is a block diagram showing the configuration of a controller of the inkjet printer shown in FIG. 1.

Next, the internal configuration of the controller 8 will be described. FIG. 4 is a block diagram showing the configuration of the controller of the inkjet printer shown in FIG. 1. As shown in FIG. 4, the controller 8 includes a main controller 81 and a mechanical controller 82.

The main controller 81 is responsible for overall control of the inkjet printer 1. The main controller 81 includes a central processing unit (CPU) 91, a memory 92, a hard disk drive (HDD) 93, an external interface (I/F) 94, a mechanical controller I/F 95, a user I/F 96, and a head I/F 97.

The CPU 91 is configured to execute arithmetic processing. The memory 92 is used as a work area for the CPU 91 for temporarily storing data and performing arithmetic operation. The HDD 93 is configured to store various programs and the like.

The external I/F 94 is configured to exchange data with external devices through a network. The mechanical controller I/F 95 is configured to connect the mechanical controller 82 to the main controller 81. The user I/F 96 is configured to connect the operation panel 5 to the main controller 81. The head I/F 97 is configured to connect the inkjet heads 11 to the main controller 81.

The mechanical controller 82 is configured to control the ink circulation and the ink supply in each printing unit 2, to control the pressure adjustment by the pressure adjuster 3, and to control the paper sheet transfer by the transfer unit 4. The mechanical controller 82 includes a CPU 101, a memory 102, a sensor I/F 103, a main controller I/F 104, an actuator I/F 105, a driver unit 106, and a latch circuit 107.

The CPU 101 is configured to execute arithmetic processing. The memory 102 is used as a work area for the CPU 101 for temporarily storing data and performing arithmetic operation. During the ink circulation, the CPU 101 controls the heat sink 43 and the heater 41 of the ink temperature adjuster 26 to adjust the ink temperature such that the temperature detected by the ink temperature sensor 27 will remain within a proper temperature range.

The sensor I/F 103 is configured to connect various sensors, such as the positive-pressure-tank liquid level sensor 32 and the negative-pressure tank liquid level sensor 37, to the mechanical controller 82. The main controller I/F 104 is configured to connect the mechanical controller 82 to the main controller 81. The actuator I/F 105 is configured to transmit control signals to the driver unit 106.

The driver unit 106 has various drivers configured to drive the ink pump 25, the air pump 59, the motors of the transfer unit 4, and other parts.

The latch circuit 107 is configured such that a latch, which is set when a power supply (sub power supply) is initially turned on after the main power supply is turned on from an off state, is held until the main power supply is turned off.

Operations and Effects

As described above, in the temperature adjustment path 45 provided inside the heater 41 and the heat sink 43, the first upflow path 47 and the second upflow path 48 are branched into the plurality of upflow paths 47*a* and the plurality of upflow paths 48*a*, respectively, thereby increasing their path lengths and therefore increasing the sum of their surface areas. Hence, the heat exchange ratio along at the path surface can be increased, and effective temperature adjustment can be achieved. On the other hand, the flow paths are merged to the downflow path 49 as a single flow path, so that the total cross-sectional area of the downflow path 49 is smaller than that of the upflow path 46. Thus, the speed of the ink flow is increased, thereby making it possible to reduce air bubbles generated and remaining in the ink at bent portions and branching points on the flow path and supply the ink smoothly.

Figure 5A:
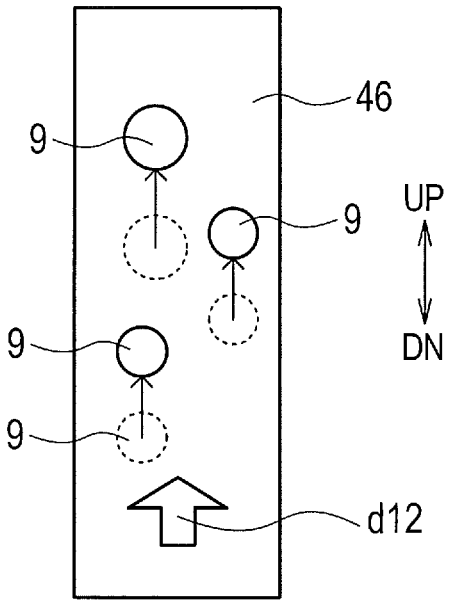
FIG. 5A is a cross-sectional view showing the inside of an upflow path of the temperature adjustment path of the inkjet printer shown in FIG. 1 and showing behavior of air bubbles inside the upflow path as seen from a lateral side.
Figure 5B:
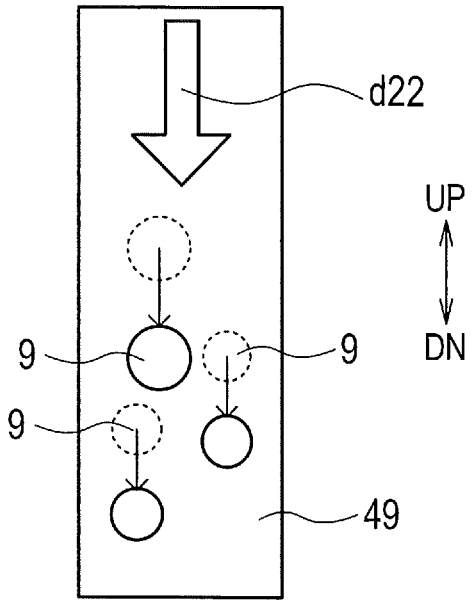
FIG. 5B is a cross-sectional view showing behavior of air bubbles inside a downflow path of the temperature adjustment path of the inkjet printer shown in FIG. 1 as seen from the lateral side.
Figure 6A:
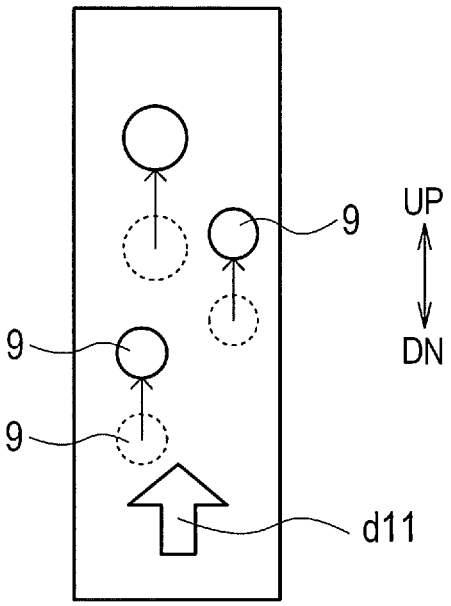
FIG. 6A RELATED ART
FIG. 6A is a cross-sectional view showing behavior of air bubbles inside an upflow path of a temperature adjustment path according to related art as seen from the lateral side.
Figure 6B:
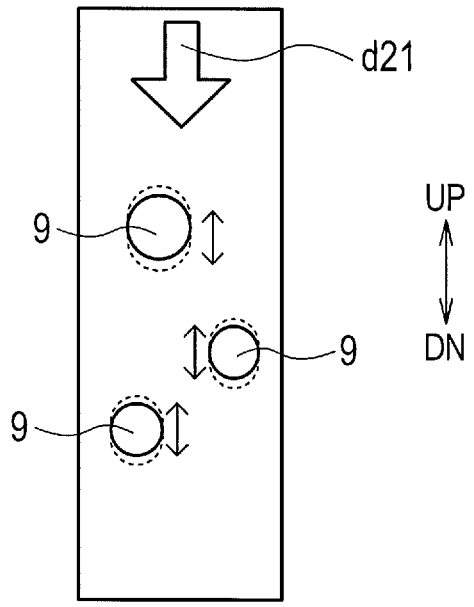
FIG. 6B RELATED ART
FIG. 6B is a cross-sectional view showing behavior of air bubbles inside a downflow path of the temperature adjustment path according to the related art as seen from the lateral side.

Specifically, in general, in an upflow path, as shown in FIG. 6A, an ink flow d11 is directed upward, and air bubbles 9 are also directed upward by their buoyancy. Then, with the presence of the ink flow, the air bubbles are less likely to remain in the flow path. In this embodiment, by taking advantage of this condition, the upflow path 46 is branched to increase the surface area thereof. In this way, the heat exchange ratio can be increased. Here, as shown in FIG. 5A, even if air bubbles 9 are generated, the air bubbles 9 naturally flow upward through the upflow path 46 with an ink flow d12 and will therefore not remain therein. On the other hand, in general, in a downflow path, as shown in FIG. 6B, air bubbles 9 are directed upward by their buoyancy whereas an ink flow d21 is directed downward, so that the air bubbles 9 are directed against the ink flow. Thus, if there are many bent portions and branching points on the flow path, the air bubbles 9 are likely to remain there. In view of this, in this embodiment, the number of bent portions and the like on the downflow path 49 is reduced, and the plurality of paths are merged to simplify the flow path and thereby make the total cross-sectional area of the downflow path 49 smaller. In this way, as shown in FIG. 5B, the speed of an ink flow d22 increases, thereby making it possible to push out the accumulated air bubbles 9 and to and smoothly supply the ink without allowing the air bubbles 9 to remain. Hence, according to this embodiment, it is possible to make the temperature adjustment more efficient by increasing the surface area and to reduce residual air bubbles at the same time.

Moreover, according to this embodiment, in the first upflow path 47; and the second upflow path 48, the lower branching path 47*c* and the lower branching path 48*c* are respectively used to branch the flow path into a plurality of flow paths, thereby making it possible to increase the surface area of the path with a simple design. The plurality of flow paths are merged to the downflow path 49 as a single flow path, thereby making it possible to achieve a simple flow path with a simple design.

Moreover, according to this embodiment, the first upflow path 47 on the inlet path side is arranged inside the heat sink 43, and the second upflow path 48 on the outlet path side is arranged inside the heater 41, and they are connected by the downflow path 49 therebetween. In this way, the temperature adjustment path can be made compact. This makes it possible to achieve size reduction of the device as a whole and space saving.

Further, according to this embodiment, the total number of the upflow paths 48*a* branched in the second upflow path 48 and the downflow path 49 is equal to the number of the upflow paths 47*a* branched in the first upflow path 47. In this way, the temperature adjustment path can be designed symmetrically between the heater 41 side and the heat sink 43 side. This makes it possible to simplify the temperature control and also avoid complication of the device.

Furthermore, according to this embodiment, by using the above ink temperature adjuster 26, effective temperature adjustment is achieved and, at the same time, air bubbles remaining in the ink are reduced and the ink is supplied smoothly into the inkjet head. The inkjet recording apparatus 1 including such an ink temperature adjuster 26 can therefore form images on a paper sheet with high accuracy. Hence, the image quality and the print rate can be improved.

Note that while the first upflow path 47 and the second upflow path 48 are branched into the plurality of upflow paths 47*a* and the plurality of upflow paths 48*a* to increase their total surface areas in the above embodiment, the present invention is not limited to this case. For example, the total surface areas may be increased by bending the first upflow path 47 and the second upflow path 48 to increase their path lengths or by making the cross-sectional shapes of the flow paths complicated. The total surface areas increased in these ways, too, can increase the heat exchange ratio along the path surface and achieve effective temperature adjustment. Meanwhile, in these cases, too, the downflow path 49 is formed as a single path to make its total cross-sectional area smaller than that of the upflow path 46. In this way, the speed of the ink flow increases, thus making it possible to reduce air bubbles generated and remaining in the ink at bent portions and branching points on the flow path and supply the ink smoothly.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An ink temperature adjustment device, comprising:

an ink temperature adjustment path connected to a midway point on an ink supply path for supplying ink to an inkjet head configured to provide an image by ejection of the ink, the ink temperature adjustment path being for adjusting a temperature of the ink supplied to the inkjet head, wherein the ink temperature adjustment path comprises:

an upflow path for the ink to flow upward in a vertical direction; and a downflow path for the ink to flow downward in the vertical direction, and a total cross-sectional area of the upflow path is larger than a total cross-sectional area of the downflow path and a flow speed of the ink in the downflow path is greater than a flow speed of the ink in the upflow path.

2. The ink temperature adjustment device according to claim 1, wherein the upflow path comprises:

a first upflow path connected to an inlet path through which the ink is introduced to an inside of the ink temperature adjustment device from an outside of the ink temperature adjustment device; and a second upflow path connected to the first upflow path via the downflow path and connected to an outlet path through which the ink is discharged to the outside of the ink temperature adjustment device from the inside of the ink temperature adjustment device.

3. The ink temperature adjustment device according to claim 2, wherein the first upflow path is branched into a plurality of first flow paths, the second upflow path is branched into a plurality of second flow paths, the downflow path is a single flow path to which the plurality of first flow paths and the plurality of second flow paths are merged, and a total number of the plurality of second flow paths and the downflow path is equal to a number of the plurality of first flow paths.

4. The ink temperature adjustment device according to claim 1, further comprising:

a heater configured to heat the ink inside the ink temperature adjustment path; and a heat sink configured to cool the ink inside the ink temperature adjustment path.

5. An inkjet printer, comprising:

an inkjet head configured to provide an image on a recording medium by ejection of ink on the recording medium based on a drive signal;

an ink supply path for supplying the ink to the inkjet head;

a recording medium transfer unit configured to transfer the recording medium relative to the inkjet head; and an ink temperature adjustment device arranged at a midway point on the ink supply path, wherein the ink temperature adjustment device comprises an ink temperature adjustment path connected to the midway point of the ink supply path, the ink temperature adjustment path being for adjusting a temperature of the ink supplied to the inkjet head, the ink temperature adjustment path comprises:

an upflow path for the ink to flow upward in a vertical direction; and a downflow path for the ink to flow downward in the vertical direction, and a total cross-sectional area of the upflow path is larger than a total cross-sectional area of the downflow path and a flow speed of the ink in the downflow path is greater than a flow speed of the ink in the upflow path.

6. The inkjet printer according to claim 5, wherein the upflow path comprises:

a first upflow path connected to an inlet path through which the ink is introduced to an inside of the ink temperature adjustment device from an outside of the ink temperature adjustment device; and a second upflow path connected to the first upflow path via the downflow path and connected to an outlet path through which the ink is discharged to the outside of the ink temperature adjustment device from the inside of the ink temperature adjustment device.

7. The inkjet printer according to claim 6, wherein the first upflow path is branched into a plurality of first flow paths, the second upflow path is branched into a plurality of second flow paths, the downflow path is a single flow path to which the plurality of first flow paths and the plurality of second flow paths are merged, and a total number of the plurality of second flow paths and the downflow path is equal to a number of the plurality of first flow paths.

8. The inkjet printer according to claim 5, further comprising:

a heater configured to heat the ink inside the ink temperature adjustment path; and a heat sink configured to cool the ink inside the ink temperature adjustment path.

* * * * *